US009803414B1

(12) United States Patent
Oberman

(10) Patent No.: US 9,803,414 B1
(45) Date of Patent: Oct. 31, 2017

(54) WINDOW GLAZING SYSTEM

(71) Applicant: Paul Oberman, Los Angeles, CA (US)

(72) Inventor: Paul Oberman, Los Angeles, CA (US)

( * ) Notice: Subject to any disclaimer, the term of this patent is extended or adjusted under 35 U.S.C. 154(b) by 326 days.

(21) Appl. No.: 14/525,854

(22) Filed: Oct. 28, 2014

(51) Int. Cl.

| | |
|---|---|
| ***E06B 3/58*** | (2006.01) |
| ***E06B 3/56*** | (2006.01) |
| ***E06B 3/54*** | (2006.01) |
| *E04F 19/02* | (2006.01) |
| *E06B 3/10* | (2006.01) |
| *E06B 3/20* | (2006.01) |
| *E06B 3/62* | (2006.01) |

(52) U.S. Cl.
CPC ..... *E06B 3/56* (2013.01); *E06B 3/5481* (2013.01); *E06B 3/5814* (2013.01); *E06B 3/5885* (2013.01); *E04F 19/02* (2013.01); *E06B 3/10* (2013.01); *E06B 3/20* (2013.01); *E06B 3/5454* (2013.01); *E06B 3/58* (2013.01); *E06B 3/62* (2013.01)

(58) Field of Classification Search
CPC . E06B 3/58; E06B 3/5814; E06B 3/10; E06B 3/5454; E06B 3/20; E06B 3/62; E04F 19/02
See application file for complete search history.

(56) References Cited

U.S. PATENT DOCUMENTS 2,716,784 A * 9/1955 Kuyper ..... E06B 3/10 52/204.705
3,271,232 A * 9/1966 Moore ..... E06B 3/5814 428/130
6,725,620 B2 * 4/2004 Dai ..... E06B 3/5814 52/204.705

* cited by examiner

*Primary Examiner* — Donald J Loney
(74) *Attorney, Agent, or Firm* — Karish & Bjorgum, PC

(57) ABSTRACT

A window glazing system includes an elongate elastomeric element having a right triangular cross section defining two leg surfaces and a hypotenuse surface with chamfers on the legs at the hypotenuse. A window pane is placed in a window frame and the interior frame and the window pane are appropriately coated with construction adhesive. The legs of the elongate element are forced into the intersection of the pane and the interior frame to spread and to be retained by the adhesive. The adhesive is then additionally forced into the chamfers and the entire assembly cleaned with solvent.

13 Claims, 3 Drawing Sheets

WINDOW GLAZING SYSTEM

BACKGROUND OF THE INVENTION

The field of the present invention is window glazing products and methods.

The glazing of windows typically includes glazing putty which is individually formed around each pane. It is very difficult to work with glazing putty, achieve consistent results and avoid creating a mess. Further, the putty's hardening time is determined by weather conditions so as to exhibit quite divergent curing properties. Further, the putty takes approximately seven days to dry which prevents other repairs and painting on the day of installation.

SUMMARY OF THE INVENTION

The present invention is directed to a window glazing product and process, which employs an elongate elastomeric element having a right triangular cross section with chamfers on the legs of the triangle at the hypotenuse. A pane of glass is positioned in a window frame and the elongate elastomeric element is then positioned to glaze the window with construction adhesive between the pane of glass and the element and between the frame of the window and the element. Excessive construction adhesive is wiped into the chamfers to complete the glazing structure.

Accordingly, a principal object of the present invention is to provide an improved glazing system for windows. Other and further objects and advantages will appear hereinafter.

DETAILED DESCRIPTION OF THE PREFERRED EMBODIMENTS

Figure 1:
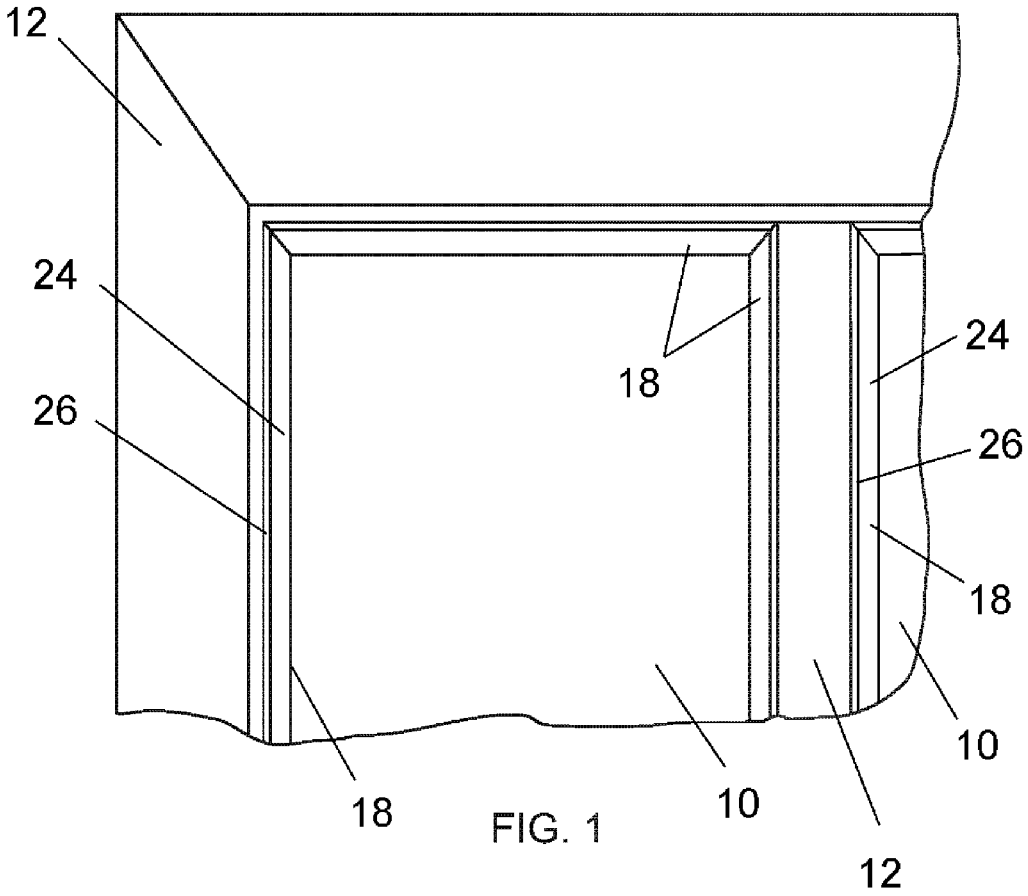
FIG. 1 is a front view of a window frame with the glazing system in place.
Figure 2:
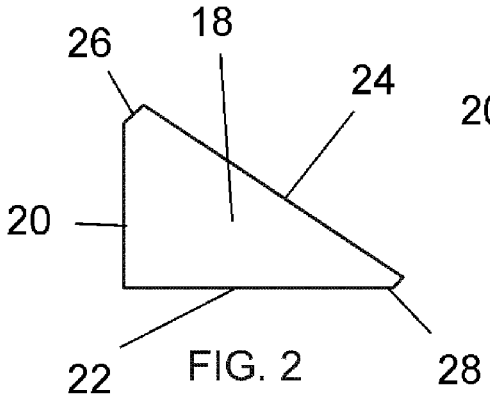
FIG. 2 is an end view of a first glazing element.
Figure 3:
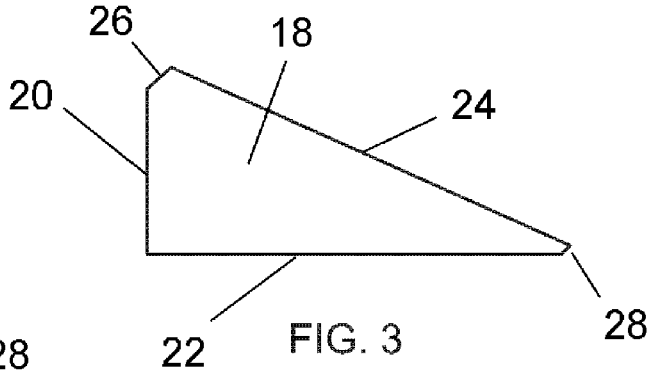
FIG. 3 is an end view of a second glazing element.
Figure 4:
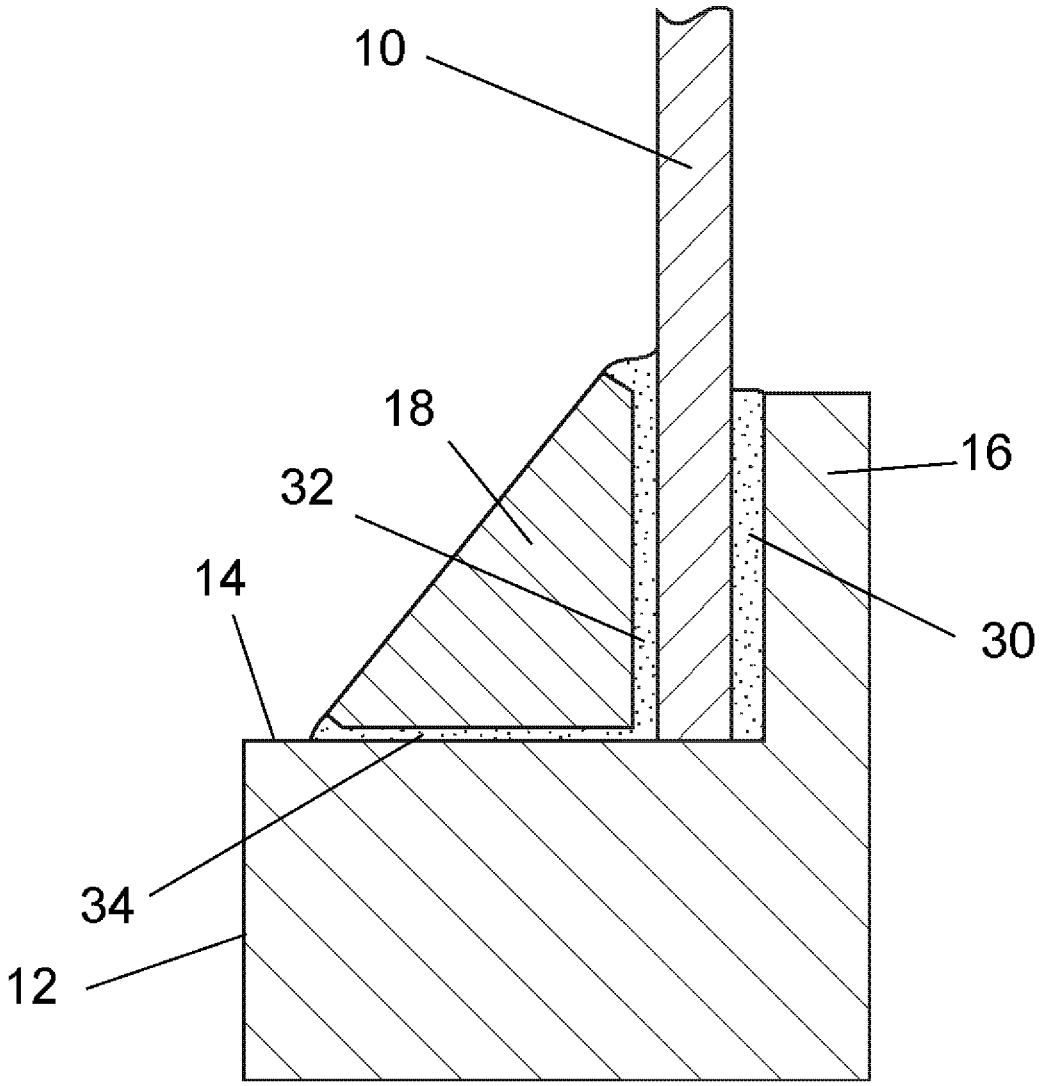
FIG. 4 is a cross-sectional view of a window pane, window frame and the glazing system in place.

Turning in detail to the drawings, FIG. 1 illustrates a glazed window according to the present system. A pane of glass 10 is positioned within a frame 12 with glazing thereabout. The frame may be any of the components such as mullions, muntins, transoms, sills and jambs which classically define a structure which can retain a pane through glazing. It is understood that such frame elements include an inner periphery 14 within which the pane is placed and a backing seat 16, such as the flange illustrated in FIGS. 4 and 5, against which one side of the pane 10 is placed.

An elongate elastomeric element 18 is employed rather than glazing putty. The elongate element may be fabricated of a continuous extrusion of styrene butylene rubber having a right triangular cross section defining two leg surfaces 20, 22 extending at right angles to one another and a hypotenuse surface 24 completing the triangular cross section. The right triangular cross section of the elongate elastomeric element 18 includes chamfers 26, 28 on the legs 20, 22 at the hypotenuse 24. There are two embodiments of the elongate elastomeric element 18 showing different applications responsive to the frame structure of the window. Other profiles are equally relevant; and "hypotenuse" is here defined as not being limited to defining a surface of the elastomeric element 18 when not used as "hypotenuse surface".

Preferably the styrene butylene rubber material includes conventional UV stabilizers and adhesion promoters. It has been found that the hardness is conveniently 85 durometer on the Shore A scale which appears hard to the touch and yet is able to be coiled about a reel for ease of application and storage prior to application. The styrene butylene rubber is also preferably formulated to be painted with either water base or oil base paints, without the need for a primer. The elongate elastomeric element 18 can also be created in colors to avoid the need for painting. The material is extremely resistant to solvents, making installation clean up easy. Cutting lengths of the extrusion also does not require specialty equipment.

The inclusion of UV stabilizers and the like as well as mold release material may require cleaning of the surfaces of the elongate elastomeric element 18 to improve adhesion. Solvents are selected to appropriately clean molding and additive substances from the elongate elastomeric element 18, such as paraffin wax from the surface. Should additional adhesion be required, the surfaces of the elongate elastomeric element 18 can be treated with ethyl acetate. Chlorination with this solvent produces improved wettability of styrene butylene rubber.

The glazing system uses urethane construction adhesive. The industry standard is referred to as modified polyurethane construction adhesive. It is used in window applications, because it will stick to metal, glass and other non-primed surfaces. In turn, modified polyurethane construction adhesive will also adhere to the cleaned styrene butylene rubber.

Before application of this system, preparation of the frame 12 to remove obstructions, dust and dirt where the pane 10 will be glazed may be needed for proper adhesion. In retrofit applications, this includes removal of all glass and previous glazing material. Preferably, the frame elements are also wiped down with solvent to remove any residue and dust.

Once cleaned, a bead 30 of construction adhesive is most easily applied to the frame backing seat 16. The pane 10 is then pressed in the window frame 12 to compress the bead 30 of construction adhesive between the backing seat 16 and a first side of the pane 10. The bead 30 may alternatively be applied to the pane adjacent to its periphery. It is advantageous to hold the pane 10 in place for thirty seconds with some pressure so as to adequately distribute the bead 30 of construction adhesive and to allow the construction adhesive to attain some adhesive strength.

The extruded triangular strip is cut to form an elongate elastomeric element 18 of appropriate length for the frame 12 to be positioned along one edge of the pane 10. The length is preferably slightly longer than the space provided in the frame 12 such that some compression is experienced in the element 18 upon its placement in the window frame 12. One eighth of an inch greater than the frame section is adequate in most installations. A 45° miter at each end of the elongate elastomeric element 18 allows adjacent strips to fit together without any space therebetween.

Once the pane 10 has been fixed in place in the frame 12 with adhesive on the first side of the pane 10, a bead 32 of adhesive is positioned between the pane 10 and the elongate elastomeric element 18 by application to one or both of the pane 10 and the first leg surface 20 of the elastomeric element 18. A further bead 34 of construction adhesive is positioned between the inner periphery 14 of the frame 12 and the elastomeric element 18 at the second leg surface 22. In the preferred embodiment, the beads of adhesive 32, 34 are located on the second side of the pane 10 and about the inner periphery 14 of the frame 12.

With beads 32, 34 in place, the elastomeric element 18 is pressed against the intersection of the second side of the pane 10 and the inner periphery 14 of the frame 12. This acts to spread the beads 32, 34 to coat the contact area between the second side of the pane 10 and the first leg surface 20 and to coat the contact area between the second leg surface 22 and the inner periphery 14 of the frame 12. An excess of construction adhesive is used for the beads 32, 34 so that there is adequate adhesive to fill the chamfers.

The elastomeric element is held there briefly to insure full distribution of the construction adhesive and to allow the construction adhesive to attain some adhesive strength. An excess of construction adhesive is applied to the pane 10 and inner periphery 14 of the frame 12 so that there is adequate adhesive to accumulate in the chamfers 26, 28 or be forced therein by wiping the pane and the inside frame toward the elastomeric element so as to fill the chamfers 26, 28. The glazing may then be wiped clean with solvent to complete the installation. As the construction adhesive dries quickly, paint can be applied relatively quickly thereafter.

Figure 5:
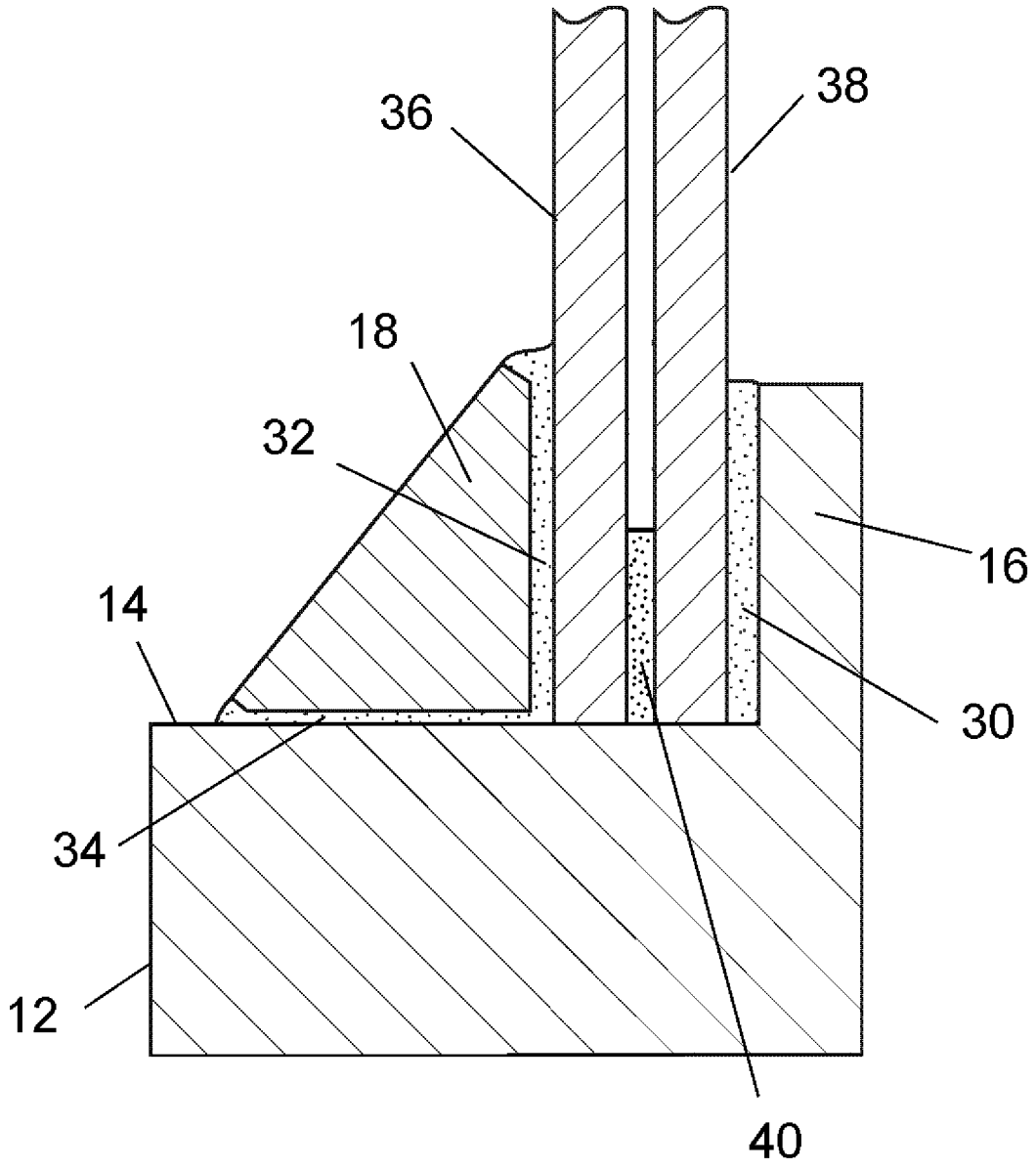
FIG. 5 is a cross-sectional view of a window pane, window frame and the glazing system in place with a double pane installation.

FIG. 5 illustrates a dual glaze application consistent with current environmental requirements. For purposes here, the dual glaze assembly of two pieces of glass 36, 38 and the desiccant 40 therebetween is defined as a "pane" as it is typically acquired as such an assembly.

Accordingly, an improved glazing system, process and apparatus, has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A window glazing process employing an elongate elastomeric element having two adjacent surfaces at right angles to one another with chamfers at edges distal to the adjacency, the window glazing process comprising placing a pane in a window frame with a first side of the pane against the window frame;

coating at least two of a second side of the pane placed in the window frame, an inner periphery of the window frame, the first adjacent surface and the second adjacent surface with an excess of construction adhesive to be between the elongate elastomeric element and the second side of the pane and between the elongate elastomeric element and the inner periphery of the window frame;

pressing the elongate elastomeric element against the coating at an intersection of the pane and the inner periphery of the window frame with the adjacent surfaces against the second side and the inner periphery of the window frame, respectively, extruding the excess of the construction adhesive from adjacent the elongate elastomeric element;

wiping the excess of the construction adhesive into the chamfers of the elastomeric element.

2. The window glazing process of claim 1 further comprising applying a bead of the construction adhesive on at least one of the first side of the pane and the window frame before placing the pane in the window frame;

pressing the first side of the pane against the window frame with the bead of construction adhesive therebetween.

3. The window glazing process of claim 1 further comprising cutting a length of the elongate elastomeric element to be larger than the adjacent intersection before pressing the length of elastomeric element into the adjacent intersection;

compressing the elongate elastomeric element lengthwise into the adjacent intersection.

4. The window glazing process of claim 3 further comprising cutting a 45° miter on each end of the length of the elastomeric element.

5. A window glazing product, comprising an elongate elastomeric element having adjacent surfaces at right angles to one another with chamfers at edges distal to the adjacency, the hardness of the element being about Shore A 85 durometer;

urethane construction adhesive between a window pane and one of the two adjacent surfaces and between a window frame and the other of the two adjacent surfaces, the urethane construction adhesive filling the two chamfers.

6. The window glazing product of claim 5, the elongate elastomeric element being of styrene butylene rubber.

7. The window glazing product of claim 6, the styrene butylene rubber including uv stabilizers and adhesion promoters.

8. Glazing for a window having a window frame, prepared by a process comprising the steps of placing a pane in the window frame;

providing an elongate elastomeric element having two adjacent surfaces at right angles to one another with chamfers at edges distal to the adjacency;

coating the pane placed in the window frame and an inner periphery of the window frame with an excess of construction adhesive to be between the elongate elastomeric element and each of the pane and the inner periphery of the window frame;

pressing the elastomeric element against the coating at an intersection of the pane and the inner periphery of the window frame with the two adjacent surfaces against the pane and the inner periphery of the window frame, respectively, extruding the excess of the construction adhesive from adjacent the elongate elastomeric element;

wiping excess of the construction adhesive on the pane and on the inner periphery of the window frame into the chamfers of the elastomeric element.

9. The glazing for a window claim 8, the hardness of the elongate elastomeric element being about Shore A 85 durometer.

10. Glazing for a window having a window frame, prepared by a process comprising the steps of providing an elongate elastomeric element having two adjacent surfaces at right angles to one another with chamfers at edges distal to the adjacency;

placing a pane in the window frame;

providing an excess of construction adhesive between the pane and one of the two adjacent surfaces and between the window frame and the other of the two adjacent surfaces;

pressing the elastomeric element against the excess of construction adhesive at an intersection of the pane and the inner periphery of the window frame with the two adjacent surfaces against the pane and the inner periphery of the window frame, respectively;

wiping excess of the construction adhesive on the pane and on the inner periphery of the window frame into the chamfers of the elastomeric element.

11. The glazing for a window of claim 10 further comprising the steps of cutting a length of the elongate elastomeric element to be larger than the adjacent intersection before pressing the length of elastomeric element into the adjacent intersection;

compressing the elongate elastomeric element lengthwise into the adjacent intersection.

12. The glazing for a window of claim 11 further comprising the step of cutting a 45° miter on each end of the length of the elastomeric element.

13. The glazing for a window claim 10, the hardness of the elongate elastomeric element being about Shore A 85 durometer.

* * * * *